United States Patent [19]

Fiala

[11] 4,203,263

[45] May 20, 1980

[54] SLINGING WHEEL FOR CENTRIFUGAL JET MACHINES

[75] Inventor: Jindrich Fiala, Schaffhausen, Switzerland

[73] Assignee: Georg Fischer AG, Switzerland

[21] Appl. No.: 956,289

[22] Filed: Oct. 31, 1978

[30] Foreign Application Priority Data

Nov. 17, 1977 [CH] Switzerland ..... 14040/77

[51] Int. Cl.[2] ..... B24C 5/06

[52] U.S. Cl. ..... 51/434

[58] Field of Search ..... 51/434, 435; 241/275; 416/187, 219 A, 220 A

[56] References Cited

U.S. PATENT DOCUMENTS

| | | | |
|---|---|---|---|
| 3,241,266 | 3/1966 | Bowling | 51/434 |
| 3,683,556 | 4/1970 | Leliaert | 51/434 |
| 3,785,105 | 1/1974 | Freeman | 51/434 |
| 4,069,025 | 1/1978 | MacMillan | 51/434 |

*Primary Examiner*—Gary L. Smith

*Attorney, Agent, or Firm*—Roylance, Abrams, Berdo & Farley

[57] ABSTRACT

The invention relates to a wheel for centrifugal jet machines with two rotating wheel discs, a plurality of centrifugal blades distributed evenly around the periphery, each blade being provided with lateral ribs or strips, the blades being insertable from the inside into radial grooves in the wheel discs and held therein by fixed stops. According to the invention, the length of the lateral strips is shorter than the diameter of the central free space of the wheel formed by the inside ends of the blades. Moreover, the width of the part of each centrifugal blade projecting beyond the lateral strips is smaller than the distance between the two discs. As a result of this dimensional relationship, the centrifugal blade can be inserted from the outside between the wheel discs in a position twisted in relation to the centrifugal axis until the lateral strips are in the central, free space and then are moved radially outwardly to a fixed stop from the inside in the grooves of the wheel discs, as a result of which centrifugal blades of any arbitrary length may be used.

8 Claims, 4 Drawing Figures

SLINGING WHEEL FOR CENTRIFUGAL JET MACHINES

This invention relates to a centrifugal slinging wheel for receiving and propelling abrasive particles by centrifugal force.

BACKGROUND OF THE INVENTION

It is known in the prior art to construct an abrasive propelling device using a pair of substantially parallel discs maintained in spaced relationship with a plurality of blades or vanes lying between the discs. Normally, abrasive material, commonly referred to as grit, is supplied to the center of the wheel while it is spinning and the material is caused to pass outwardly along the vanes to be thrown against a receiving surface at relative high velocity. A wheel of this general type is known from German Pat. No. 23 11 866 (which corresponds to U.S. Pat. No. 3,785,105) wherein the length of the radially extending centrifugal blades is shorter than the diameter of a central space circumscribed by the inner ends of the blades in their installed positions. A disadvantage of this structure is that it is necessary that the central aperture in the front wheel disc as well as the aperture in a cover surrounding the driving wheel be larger in their diameters than the total length of each centrifugal blade in order that the blade can be mounted by passing them through the central opening when it is necessary to replace the blades.

The outside diameters of the wheel discs depend upon the lengths of the centrifugal blades as a result of which no optimal design of the wheel is possible with regard to its centrifugal case in the case of simultaneously small rotating masses. An increase of the speed of release, under conditions of a constant speed, by the use of longer centrifugal blades is thus likewise not possible in this previously known wheel structure. The spacers between the wheel discs simultaneously perform the function of spacing and also act as stops for the restraint of the centrifugal blades against outward motion. Thus, it is necessary in this structure that a spacer must be assigned to each centrifugal blade. As a result of that, the spacers and thus also the front wheel disc which, in most cases, is weaker, are under unnecessary stress from the centrifugal force of the rotating centrifugal blades.

Another form of wheel is shown in German Pat. No. 21 15 354 (which corresponds to U.S. Pat. No. 3,745,711) which has centrifugal blades insertable from the outside to the inside. In a structure of this type, it is possible to insert centrifugal blades of any arbitrary length into a predetermined fly wheel structure, but in that case stops movable to the outside and in the form of rotatable bushings on the spacer bolts are needed for the support of the centrifugal blades. Such stops are very expensive and, moreover, it is often necessary to expend considerable energy to move them, and then only with special tools, because of particles of the blasting medium which become jammed in between relatively movable components when replacement of the blades is desired.

BRIEF DESCRIPTION OF THE INVENTION

An object of the present invention is to provide an improved grit slinging wheel wherein the lengths of the centrifugal blades can be chosen for an optimum design of the wheel or for an adaptation of the speed of release of the blasting medium onto the material, such as castings, to be treated.

Briefly described, the invention includes an improved centrifugal propelling wheel for a centrifugal jet machine, the wheel being of the type having first and second discs, at least the first disc being annular with a central opening, spacer means for maintaining the discs in substantially parallel spaced relationship, means defining uniformly distributed radially extending grooves in the inwardly facing surfaces of the discs, blades insertable in the grooves in their installed, operating positions, and means coupled to the second disc for rotating the wheel, the grooves and the discs defining a central cylindrical volume of predetermined diameter, the improvement wherein each of the blades includes a disc-engaging end portion having rib means shaped and dimensioned for engaging said grooves, said end portion having a length smaller than said predetermined diameter, the remaining portion of each of said blades having a maximum transverse dimension smaller than the minimum distance between the inwardly facing surfaces of said discs, whereby each of said blades can be radially inserted between said discs from outside the periphery thereof in an orientation rotated from its installed position until said end portion occupies said central volume, rotated into alignment with its installed position, and extracted radially to engage selected ones of said grooves.

As a result of this dimensional relationship between the blades and the disc spacing, each blade can be inserted from the outside in a position twisted in relation to the axis of the wheel until the lateral strips are located in the central free space and then pushed or pulled backwardly from the inner portion to engage the grooves of the wheel discs up to a fixed stop. In this structure, any length of centrifugal blade can be used independently of the dimensions of the fly wheel.

This structure is particularly advantageous because it is always possible to choose an optimal design of factors including the desired speed of release of the blasting medium but with small fly wheel mass and simple mounting and dismounting of the centrifugal blades.

In order that the manner in which the foregoing and other objects are attained in accordance with the invention can be understood in detail, particularly advantageous embodiments thereof will be described with reference to the accompanying drawings, which form a part of this specification, and wherein.

Figure 2:
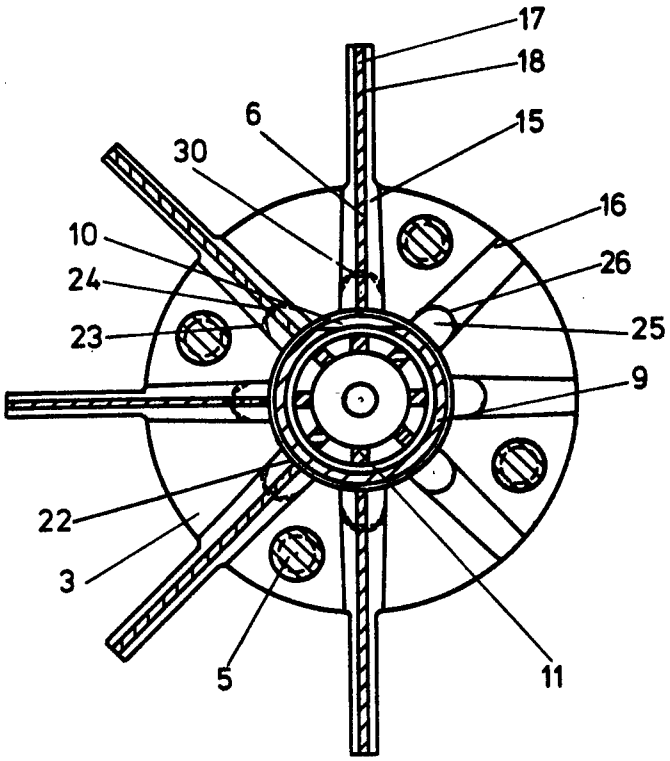
FIG. 2 is a transverse section along line II—II of FIG. 1, with some of the blades thereof removed.
Figure 1:
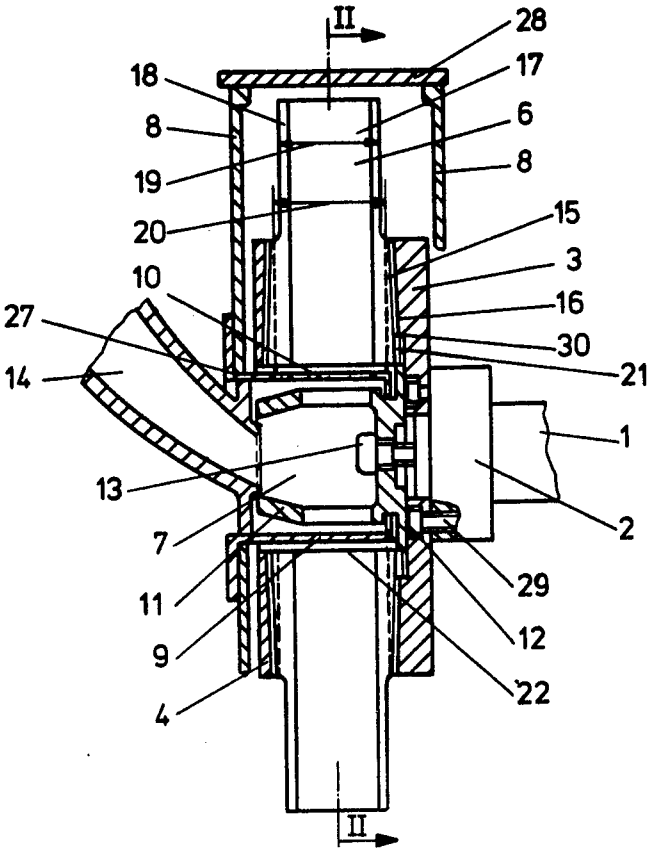
FIG. 1 is a side elevation, in longitudinal section, through the axis of rotation of the centrifugal wheel in accordance with the present invention.

Referring now to the drawings in detail, it will be seen that FIGS. 1 and 2 show an abrasive slinging wheel which is fixedly attached to a driving shaft 1 for rotation therewith, the shaft being drivable by a motor, not shown. A disc 3 of the wheel is attached to a flange 2 of driving shaft 1 by screws 29, and a disc 4, which forms the front side wall of the structure, is mounted on a plurality of spacers 5 which establish and maintain a predetermined spacing between discs 3 and 4 with the discs in substantially parallel relationship.

A plurality of radially extending centrifugal blades 6 are circularly distributed evenly between discs 3 and 4, the radial outward ends of the blades projecting beyond the outer periphery of discs 3 and 4 and the radial inner ends 22 of the blades being radially spaced from the rotational axis of the wheel so as to define a central cylindrical chamber 7. The entire wheel structure is enclosed within a housing 8, the design of the housing being conventional, the housing having at some point around the periphery thereof an opening for the exit of the blasting medium which is flung away through the action of the wheel.

In the central chamber 7, an apparatus for the supply of the blasting medium and for the control of the centrifugal jet is disposed. This apparatus includes a cylindrical control basket 9 with an exit opening 10 for the blasting medium. The control basket 9 is attached to the housing 8 and is centered in a central opening 27 of the housing. The position of the exit opening 10 can be adjusted by a rotational movement with respect to housing 8 as a result of which the direction of the blasting medium particles dispensed by the fly wheel is established.

In the inside of the control basket 9 is a rotor 11 which serves for the pre-acceleration of the blasting medium and which, together with a centering plate 12, is attached coaxially to the driving shaft 1 by means of a screw 13. Centering plate 12 and rotor 11 can be formed in one piece, as shown in FIG. 1. A supply pipe 14 attached to housing 8 and centered in the control basket 9 serves for the supply of the blasting medium into the inner volume of rotor 11.

The centrifugal blades 6 are provided with longitudinally extending and laterally protruding ribs or strips 15 which, when the blades are inserted in their operating, installed positions, lie in and mate with radially extending grooves 16 formed on the inner surfaces of discs 3 and 4. The lengths of grooves 16 correspond to the lengths of strips 15 so that in the inserted state, the lateral strips 15 do not project beyond the outside diameter of discs 3 and 4. The longitudinal extent of ribs 15 thus define a disc-engaging end portion on each of the blade members.

The lateraly protruding ribs 15 and the mating grooves 16 need only be as long as is required for the transfer of the peripheral forces from centrifugal blades 6 to discs 3 and 4 without excessive contact pressures and for a secure guiding of blades 6.

The central free volume 7 must be slightly greater in its diameter than the length of lateral ribs 15 for proper insertion of blades 6 into the grooves 16 from the inside, as will be later described. Since the control basket 9 is mounted in space 7, this condition is fulfilled in most cases already by the required dimensions of basket 9.

The portion 17 of each of blades 6 projecting beyond the lateral strips has, on the sides of the throwing surface, an elevated margin 18 which serves for guiding the blast medium. The width 19 of part 17 inclusive of margin 18 is smaller than the minimum spacing 20 between the inwardly facing surfaces of discs 3 and 4, as will be seen in FIGS. 1 and 4.

Each of blades 6 is provided, at its radially inward end, and protruding beyond the outer surface of one of ribs 15, a projection 21 of the material from which the blade is formed. The projection 21 has a rectangular cross section and extends from the inner end 22 of the blade over a partial length of rib 15. The end of the material projection 21 facing the release end of the blade is formed by two converging slanting surfaces 23 and by a stop surface 24 which extends perpendicularly to the longitudinal axis of the blade itself, and, therefore, to the direction of insertion. On the inner surface of disc 3, which is the disc mounted on the drive shaft, and at the radial inward end of each of grooves 16, there is provided a recess 25, the radial outer portion of which is a circularly shaped stop surface 26. Stop surface 26, together with the stop surface 24 of the projection formed on the blade, forms a fixed stop 30 which limits the extent of insertion and holds each of the centrifugal blades 6 from moving radially outwardly after it has been placed in its operatively installed position. After installation, the blades 6 are prevented from moving inwardly by insertion of centering plate 12, best seen in FIG. 1.

Other embodiments of fixed stops 30 are also possible such as, for example, a peg disposed on the disc which cooperates with a stop surface on the lateral rib of the centrifugal blade.

As a result of the arrangement of the fixed stop 30 cooperating with a recess formed only on that disc 3 which is mounted on the drive shaft, the centrifugal forces developing at the blade 6 as a result of rotation are transferred directly from disc 3 to drive shaft 1 and its mounting. The outside disc 4 and the spacers 5 are therefore not subjected to these centrifugal forces and it is therefore possible to employ a somewhat smaller number of spacers 5 than would otherwise be needed. In the embodiment shown by way of example, a spacer 5 is fixedly attached between discs 3 and 4 only between alternate ones, i.e., every other one of blades 6.

Figure 3:
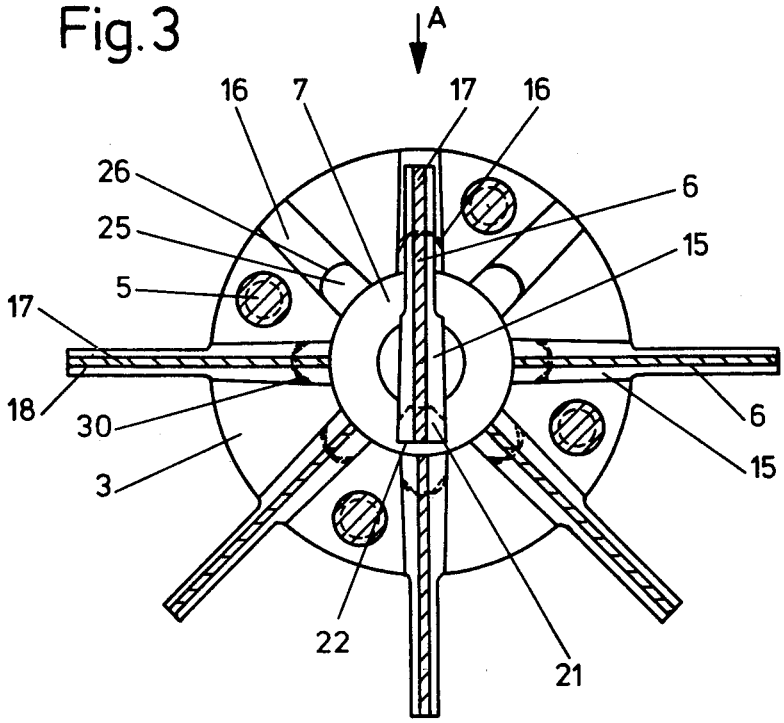
FIG. 3 is a view similar to FIG. 1 illustrating a partially inserted blade.
Figure 4:
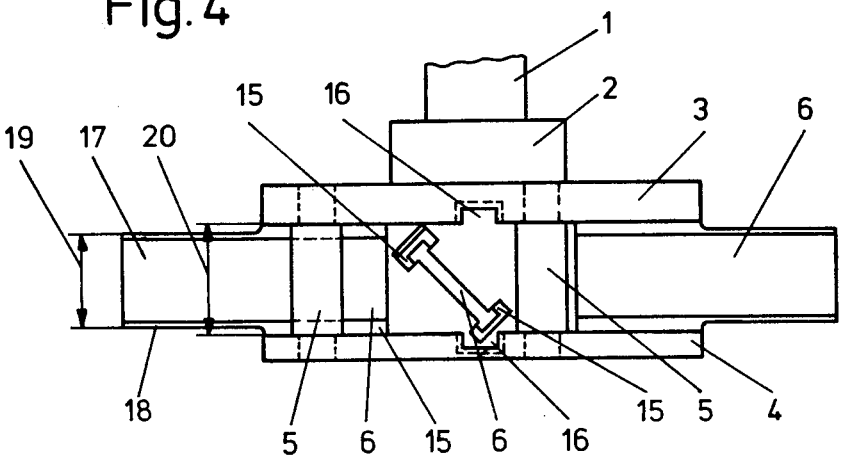
FIG. 4 is a top plan view, in the direction of arrow A of FIG. 3, illustrating a step in the insertion of a blade.

As will be recognized, it is necessary to periodically replace unusable centrifugal blades as a result of wear and damage. This replacement is accomplished as shown in FIGS. 3 and 4. Initially, the supply pipe 14 for the blasting medium is removed from housing 8, thus exposing control basket 9, rotor 11, centering plate 12 and screw 13. By releasing screw 13, the centering plate 12 and the rotor 11 can be extracted together with control basket 9 by pulling them axially through the central opening 27. Then the centrifugal blades are freely movable inwardly so that each one can be inwardly moved until the groove-engaging portion thereof lies in the cylindrical space 7. By removing an upper covering 28 of housing 8, the blades are accessible from the outside. By pressing from the outside, to overcome the sticking of the blades, the blades are pushed toward the inside until the ribs 15 emerge from grooves 16. As previously indicated, this is possible because the diameter of volume 7 is chosen to be greater than the length of ribs 15.

The portion 17 of each of blades 6, which constitutes the remainder of the blade beyond strips 15, is at this point still located between discs 3 and 4. The width 19 of portion 17 is chosen to be slightly less than the distance 20 between the discs 3 and 4 so that the blades 6 can now be rotated about their longitudinal axes to assume an acute angle with respect to the centrifugal axis. In this position, each blade 6 can be pulled radially outwardly between the discs without interference.

The replacement blades can then be inserted, in the same slanting position, between discs 3 and 4 until the groove-engaging portion thereof is in volume 7. The blades are then individually rotated into positions parallel to their operating positions and to the centrifugal axis and can be radially outwardly moved, i.e., inserted from the inside, so that their ribs 15 again engage grooves 16. The outermost, final position of the blades is achieved by radially pushing the blades out until projections 21 fully engage recesses 25. Once all of the blades have been installed, the centering place 12, the rotor 11 and the control basket 9 can again be inserted so that, once again, the replaced centrifugal blades are held in their operating positions by centering plate 12.

By the arrangement of the spacer 5 between alternate ones of blades 6, there remains adequate space, even in the case of small diameter wheels, between spacer 5 and a previously inserted blade 6 that a new blade to be mounted therebetween can be inserted in a slanting position from the outside. Furthermore, as a result of the arrangement of the fixed stop 30 on only one of the discs, the oblique insertion of the centrifugal blade is likewise facilitated.

In the embodiment shown, the grooves 16 and ribs 15 are developed with a taper, i.e., wedge-shaped, for the purpose of easier disassembly. It will be recognized, however, that the grooves and the mating ribs can be formed and dimensioned such that the opposite surfaces thereof are parallel.

The wheel according to the invention makes possible the use of the blades of any arbitrary length which project beyond the peripheries of the discs independently of the size of the discs and, at the same, time, the fixed stop structure for the support of the centrifugal blades against outward movement makes possible the easy replacement of the blades without special tools.

While certain advantageous embodiments have been chosen to illustrate the invention, it will be understood by those skilled in the art that various changes and modifications can be made therein without departing from the scope of the invention as defined in the appended claims.

What is claimed is:

1. A centrifugal blasting wheel comprising first and second discs having uniformly distributed, radially extending grooves in inwardly facing surfaces thereof, said grooves and said discs defining a central cylindrical volume of predetermined diameter;

spacer means for maintaining said discs in substantially parallel relationship; and a plurality of blades releasably mounted to and between said discs, each of said blades having a disc-engaging end portion with rib means shaped and dimensioned for engaging said grooves, each said end portion having a length smaller than said predetermined diameter, and a remaining portion with a maximum transverse dimension smaller than a minimum distance between said inwardly facing surfaces of said discs;

whereby each of said blades may be radially inserted between said discs from outside the periphery of said discs in an orientation rotated from its installed position until said end portion occupies said central volume, be rotated about its longitudinal axis and be extracted radially to engage selected ones of said grooves.

2. A centrifugal blasting wheel according to claim 1, wherein said discs include an even number of grooves to receive an even number of blades, and wherein said spacer means consists of a plurality of spacer members equal to one-half the number of blades, said spacer members being disposed in alternate ones of the sectors between said blades.

3. A centrifugal blasting wheel according to claim 1, wherein each of said blades includes a stop member protruding laterally from one edge of the blade adjacent the radially inward end thereof.

4. A centrifugal blasting wheel according to claim 3, wherein each of said grooves in said second disc includes a recess adjacent the radially inward end thereof for receiving one of said stop members.

5. A centrifugal blasting wheel according to claim 1, wherein said first disc is annular and has a central opening.

6. A centrifugal blasting wheel according to claim 1, wherein said second disc has means coupled thereto for rotating the wheel.

7. A centrifugal blasting wheel according to claim 1, wherein each of said blades has a longitudinal dimension greater than said predetermined diameter.

8. A centrifugal blasting wheel according to claim 1, wherein said rib means have longitudinal dimensions greater than one-half of said predetermined diameter.

* * * * *